US006935576B2

(12) United States Patent
Hara

(10) Patent No.: US 6,935,576 B2
(45) Date of Patent: Aug. 30, 2005

(54) CLEANING NOZZLE AND CLEANING APPARATUS

(75) Inventor: Shinichi Hara, Ishikawa (JP)

(73) Assignee: Shibuya Kogyo Co., Ltd., Ishikawa (JP)

( * ) Notice: Subject to any disclaimer, the term of this patent is extended or adjusted under 35 U.S.C. 154(b) by 394 days.

(21) Appl. No.: 09/894,008

(22) Filed: Jun. 29, 2001

(65) Prior Publication Data

US 2002/0000477 A1 Jan. 3, 2002

(30) Foreign Application Priority Data

Jun. 30, 2000 (JP) ..... P. 2000-199749
Jun. 30, 2000 (JP) ..... P. 2000-199750
Nov. 29, 2000 (JP) ..... P. 2000-363890

(51) Int. Cl.[7] ..... B05B 1/28; B05B 15/02

(52) U.S. Cl. ..... 239/104; 239/106; 239/112; 239/398

(58) Field of Search ..... 239/104, 106, 239/112, 280, 398, 433, 434, 418, 424, 532, 548

(56) References Cited

U.S. PATENT DOCUMENTS 4,134,547 A 1/1979 Gamst
4,787,404 A * 11/1988 Klosterman et al. ..... 134/198
4,817,342 A 4/1989 Martin et al.
5,509,849 A 4/1996 Spears, Jr.
5,520,331 A 5/1996 Wolfe
5,529,242 A 6/1996 Hedin
6,386,466 B1 * 5/2002 Ozawa et al. ..... 239/433

FOREIGN PATENT DOCUMENTS

| | | | |
|---|---|---|---|
| DE | 1 036 497 | 8/1958 | |
| DE | 41 20 613 A1 | 3/1992 | |
| EP | 0 635 702 A1 | 1/1995 | |
| JP | 60-261566 | 12/1985 | ..... B05B/7/06 |
| JP | 10-156229 | 6/1998 | ..... B05B/7/04 |
| JP | 63-212469 | 9/1998 | ..... B24C/3/28 |
| WO | WO 90/11877 A1 | 10/1990 | |

* cited by examiner

*Primary Examiner*—Davis Hwu
(74) *Attorney, Agent, or Firm*—Sughrue Mion, PLLC

(57) ABSTRACT

In a cleaning nozzle, a trumpet-shaped portion made up of multiple inclined portions or a curved portion is formed upstream of a minimum diameter portion of an ejection nozzle portion of a converging-diverging shape, and a gas ejection port is opened to an intermediate part of the trumpet-shaped portion. Inside the gas ejection port is formed a cleaning liquid ejection port. A gas is ejected at a higher speed than that of a cleaning liquid from the cleaning liquid ejection port to transform the cleaning liquid into droplets, which are further accelerated by a tapered portion formed downstream of the minimum diameter portion before being ejected. A small amount of liquid may be supplied to a pressurized gas passage between a powder injection portion and the cleaning nozzle to prevent a possible clogging of passage due to powder.

34 Claims, 14 Drawing Sheets

CLEANING NOZZLE AND CLEANING APPARATUS

BACKGROUND OF THE INVENTION

1. Field of the Invention

The present invention relates to a cleaning nozzle applicable to a wide range of cleaning operations on automobiles, buildings' wall surfaces, bottles and dishes, and more specifically to an improved cleaning nozzle that has an improved performance of mixing and accelerating a gas and a cleaning liquid to enhance a uniformity of the gas-liquid mixture flow containing droplets of the cleaning liquid and to eject the liquid droplets at high speed. This invention also relates to an improved technique to prevent a passage clogging due to a powder material which can occur when the powder material is used to take advantage of its delaminating action in further improving the performance of removing sticky dirt.

The present application is based on Japanese Patent Applications No. 2000-199749, 2000-199750 and 2000-363890, which are incorporated herein by reference.

2. Description of the Related Art

The cleaning nozzle of this kind for ejecting a gas-liquid mixture flow is known to be available in two types: one in which a gas ejection port is provided on the outside, enclosing a liquid ejection port, and one in which a liquid ejection port is provided on the outside, enclosing a gas ejection port. The present invention relates to an improvement in the former type in which the gas ejection port is provided on the outside. In the cleaning nozzle that utilizes the cleaning action of the gas-liquid mixture flow, the state and ejection speed of the gas-liquid mixture flow ejected from the cleaning nozzle are important. That is, the higher the ejection speed of the liquid droplets, the greater the physical action produced by the liquid droplets striking against the target surface being cleansed and the better the resultant cleaning action. If the gas-liquid mixture state is good and the liquid droplets are highly uniform, a stable cleaning action can be obtained. For example, a technical means is disclosed (Unexamined Japanese Patent Publication Sho. 60-261566 and Unexamined Japanese Patent Publication Hei. 10-156229) in which a trumpet-shaped portion is formed upstream of a minimum diameter portion of the nozzle and in which the cross-sectional area of the gas passage in the trumpet-shaped portion is progressively throttled to accelerate the gas as it is mixed with the liquid.

With the conventional technique, however, because the passage cross section is simply throttled at the trumpet-shaped portion formed upstream of the minimum diameter portion of the nozzle, there is a limit to the mixing of gas and liquid and the acceleration of droplets. Hence, there is a room for improvement.

As for the aforementioned conventional techniques, more detailed explanations are provided hereinafter.

In Unexamined Japanese Patent Publication Sho. 60-261566, there is disclosed such that a gas ejection portion in the nozzle is formed as a converging-diverging tube, which is once narrowed and progressively expands toward the downstream end thereafter, in order to accelerate the gas to a sonic or supersonic speed before mixing it with a liquid. This conventional technology has the following drawbacks. Because a ring-shaped ejection port, which is installed in the narrow gas ejection portion in the nozzle, must have a narrow converging-diverging shape in a longitudinal cross section, not only does the structure of the gas ejection portion become complex and difficult to machine but also the nozzle cannot always eject a high-speed gas-liquid mixture flow. In the case of a nozzle made of a straight cylindrical tube, it is technically impossible to increase the ejection speed above the sonic speed even by coordinating or improving the ejection conditions. In other words, the structure of the straight tube ejection nozzle imposes a limitation on an increase in the ejection speed.

Further, in a Laval nozzle or converging-diverging nozzle which has a trumpet-shaped portion in front of a minimum diameter portion and a diverging tapered portion after the minimum diameter portion, if a relative pressure relationship among the trumpet-shaped inlet portion, the minimum diameter portion and the tapered outlet portion is adjusted properly, the flow speed at the rear tapered portion increases to a sonic speed or even supersonic speed—a speed increasing phenomenon widely known in the fluidics (see "Mechanical Engineering Handbook" published by Japan Mechanical Engineers Association (Nihon Kikai Gakkai) (Apr. 15, 1987), A5-page 58). Under these circumstances, a technique for increasing ejection speed has been proposed which uses a converging-diverging nozzle or Laval nozzle to realize a supersonic ejection speed in Unexamined Japanese Patent Publication Hei. 10-156229. Although this conventional technique discloses, as a means of realizing a supersonic flow speed, an abstract method of increasing the ejection speed to a supersonic speed by utilizing the speed increasing phenomenon at the rear tapered portion of the Laval nozzle, it fails to give a sufficient explanation on the state of the gas-liquid mixture flow ejected from the nozzle, i.e., as to how a uniformly distributed liquid droplets can be ejected stably.

Furthermore, in a cleaning nozzle which mixes gas and liquid therein to form and eject a gas-liquid mixture flow as the cleaning medium, when a powder material is added to take advantage of the delaminating action of the powder, a problem arises that the powder accumulates in parts of the passage where the flow speed slows down or where flow resistance is large, degrading the performance of the cleaning nozzle. When the powder used is water-soluble powder, such as sodium hydrogencarbonate, the powder easily absorbs humidity and turns into a solid lump that adheres to the wall surface of the passage. Further, the powder easily adheres to and cloggs on protrusions and stepped portions in a passage of the cleaning nozzle. When using hard powder, the passage may be damaged.

SUMMARY OF THE INVENTION

The present invention has been accomplished under these technical situations. It is an object of the present invention to provide a cleaning nozzle which efficiently transfers the energy of the pressurized gas flow to liquid droplets to accelerate the mixing of gas and cleaning liquid in the trumpet-shaped portion and thereby improve the uniformity of the liquid droplets making up the gas-liquid mixture flow produced in the trumpet-shaped portion; and which further mixes and accelerates the liquid droplets in a passage downstream of the trumpet-shaped portion to produce a powerful, uniformly mixed high-speed droplet jet flow with an improved cleaning capability.

From another point of view, it is another object of the present invention to provide a cleaning nozzle which uses a pressurized gas and the speed increasing effect of the converging-diverging nozzle to accelerate and eject liquid droplets at high speed by efficiently transferring the energy of the pressurized gas flow to the droplets with a simple means and which also produces a gas-liquid mixture flow with high uniformity, thereby improving the cleaning action.

Moreover, it is still another object of this invention to provide a cleaning apparatus that can easily prevent the powder from clogging the passage.

To solve the above problems, the present invention from the first aspect adopts a technical concept which comprises: a trumpet-shaped portion formed by multiple inclined portions at a location upstream of a minimum diameter portion of an ejection nozzle portion; a gas ejection port formed along the inclined portions and opened to an intermediate part of the trumpet-shaped portion; an inclined portion having its inclination angle with respect to an axis of the ejection nozzle portion set smaller than an ejection angle of the gas ejection port and interposed between the gas ejection port and the minimum diameter portion; and a cleaning liquid ejection port formed inside the gas ejection port; wherein a gas is ejected from its associated ejection port at a speed higher than that of a cleaning liquid to transform the cleaning liquid into droplets and at the same time accelerate them.

FIG. 1 is an essential-part construction diagram showing the feature of the invention from the aforementioned first aspect As shown, a trumpet-shaped portion formed upstream of a minimum diameter portion 2 of an ejection nozzle portion 1 is constructed of multiple inclined portions 3, 4. A gas ejection port 5 is formed along the inclined portion 3, and an inclined portion 4 with a small inclination angle is interposed between the gas ejection port 5 and the minimum diameter portion 2 to expand a gas-liquid mixing space immediately upstream of the minimum diameter portion 2. As a result, the cleaning liquid ejected in a liquid flow state is transformed into droplets which are then accelerated by the gas jet accelerated by the trumpet-shaped portion. The presence of the inclined portion 4 causes the minimum diameter portion 2 to be shifted downstream by a distance L relative to a position 2' where the minimum diameter portion would have been formed had there not been the inclined portion 4. As a result, a focus 7 onto which the gas jet flow 6 ejected from the gas ejection port 5 converges is moved upstream relative to the minimum diameter portion 2. This means that a gas-liquid mixing space where the gas ejected from the gas ejection port 5 and the cleaning liquid ejected from the ejection port 9 of the cleaning liquid ejection portion 8 disposed inside the gas ejection port are mixed together is moved upstream relative to the minimum diameter portion 2. This in turn facilitates the gas-liquid mixing that occurs immediately upstream of the minimum diameter portion 2. With this invention, because a high-speed jet flow of liquid droplets uniformly distributed by the gas-liquid mixing action is produced, a stable, powerful cleaning action can be obtained. It should also be noted that when the uniformly mixed gas-liquid mixture flow, which was produced as described above by the trumpet-shaped portion, flows past the minimum diameter portion 2 and down an ejection passage further downstream, the mixture flow is subjected to additional mixing and acceleration actions.

The invention from the second aspect adopts a technical concept which comprises: a trumpet-shaped portion formed by a curved surface; a gas ejection port formed along the curved surface and opened to an intermediate part of the trumpet-shaped portion; and a cleaning liquid ejection port formed inside the gas ejection port; wherein a gas is ejected from its associated ejection port at a speed higher than that of a cleaning liquid to transform the cleaning liquid into droplets and at the same time accelerate them. In this invention, too, because the inclination angle of the tangent to the curved surface situated between the gas ejection port and the minimum diameter portion progressively decreases, the focus on which the gas jet flow ejected from the gas ejection port converges is shifted upstream relative to the minimum diameter portion, increasing the mixing space. This further facilitates the gas-liquid mixing action, which in turn improves the uniformity of mixed state of the cleaning liquid droplets and produces a powerful, stable cleaning action.

The invention from the third aspect adopts a technical concept which comprises: a trumpet-shaped portion formed upstream of a minimum diameter portion of a converging-diverging nozzle portion; a gas ejection port formed along the trumpet-shaped portion and opened into an intermediate part of the trumpet-shaped portion; and a cleaning liquid ejection port formed inside the gas ejection port; wherein a gas is ejected at a higher speed than that of a cleaning liquid to transform the cleaning liquid into droplets and the droplets are further accelerated downstream of these ejection ports before being ejected out from the cleaning nozzle. According to this invention, because the gas ejection port is formed along the trumpet-shaped portion, which is located upstream of the minimum diameter portion of the converging-diverging nozzle portion, the gas jet flow converges into the central portion as it effectively mixes with the cleaning liquid jet flow and the droplets formed as a result of the mixing of gas and liquid are accelerated. Then, the cleaning liquid droplets formed and accelerated by the trumpet-shaped portion are further accelerated effectively at a location downstream of the minimum diameter portion by the speed increasing phenomenon of the converging-diverging nozzle. The tapered portion downstream of the minimum diameter portion has the advantages of minimizing losses and therefore decelerations of the gas-liquid mixture flow caused by nozzle wall and thus contributes to high-speed ejection of droplets, whether the jet flow reaches a sonic or supersonic speed or stays below the sonic speed. That is, this invention ensures that the highly uniform droplet flow can be ejected at high speed stably with a simple construction of the nozzle by taking advantage of the synergistic effect of actions—the liquid droplet generating and accelerating actions produced by the effective gas-liquid mixing at the trumpet-shaped portion upstream of the minimum diameter portion and the further droplet accelerating and mixing actions at an area downstream of the minimum diameter portion. Further, because the ejection nozzle portion adopts the converging-diverging shape, it is possible to increase the ejection speed of the droplets to a sonic or supersonic speed by properly correlating the gas ejection conditions and the inner shape of the nozzle and taking advantage of the speed increasing effect of the Laval nozzle. The invention therefore is very effective in improving the cleaning performance particularly for removing sticky dirt.

The aforementioned technical concepts from the all aspects of the invention can be modified according to the following optional matters.

If the gas jet flow passing through the central part of the gas ejection port is made to converge at a point upstream of the minimum diameter portion so that the gas-liquid mixture flow converges immediately before the minimum diameter portion, the gas-liquid mixing action can further be improved. If the cross-sectional area of the gas ejection port perpendicular to the axis direction is reduced progressively toward its downstream open end, the gas ejection speed can further be accelerated. Further, if the cross-sectional area of the gas ejection port at its downstream open end is set almost equal to or slightly smaller than that of the minimum diameter portion, a reduction in the flow speed can be minimized throughout the entire passage and a stable, high-speed gas-liquid mixture flow can be produced. For example, the ratio between the cross-sectional area of the gas ejection port at its downstream open end and the cross-sectional area of the minimum diameter portion may be set to 1:1 to 1:1.3. Further, if the distance from the cleaning liquid ejection port to the downstream end of the ejection nozzle portion is set to 10–50 times the diameter of the minimum diameter portion, sufficient mixing and acceleration actions in the ejection nozzle portion can be obtained, producing a uniformly mixed, high-speed droplet jet flow. Further, it is possible to supply a powder material into a passage upstream of the gas ejection port.

To prevent a possible clogging of the passage when a powder material is injected, a small amount of clogging prevention liquid may be injected into an intermediate section of the pressurized gas passage between the powder injection portion and the cleaning nozzle. In that case, the amount of clogging prevention liquid to be injected needs only to be large enough to prevent the powder from accumulating in the passage. Too large an amount of the clogging prevention liquid injected may cause pulsations in the pressurized gas flow or reduce the speed of the pressurized gas flow. Therefore, it is desirable to set the amount of the clogging prevention liquid smaller than that of the liquid supplied to the cleaning nozzle, or smaller by weight than that of the powder injected, or smaller by volume than 1/1000 that of the pressurized gas flow. It is also effective to continue supplying the clogging prevention liquid for a predetermined duration after the injection of powder into the pressurized gas flow has been stopped.

Features and advantages of the invention will be evident from the following detailed description of the preferred embodiments described in conjunction with the attached drawings.

DETAILED DESCRIPTION OF THE PREFERRED EMBODIMENTS

Figure 1:
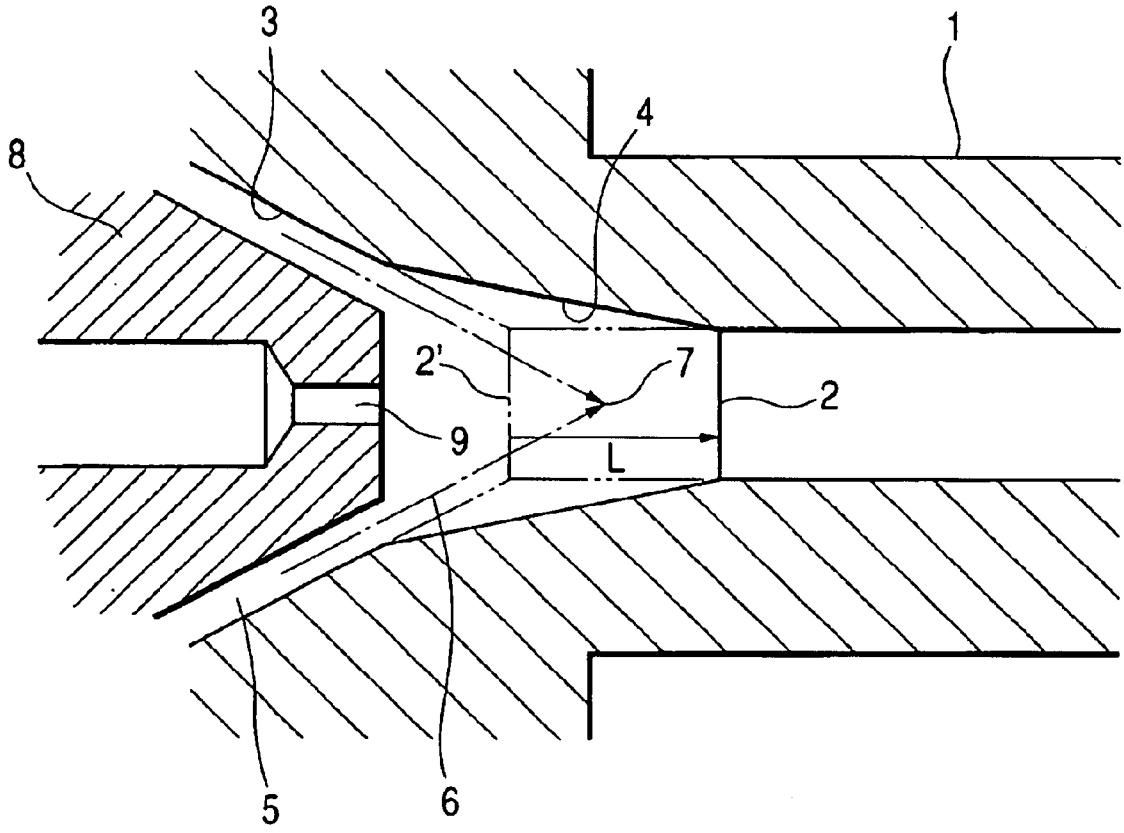
FIG. 1 shows an essential-part structure diagram showing a feature of the invention.

The cleaning nozzle of the present invention can be used widely in a variety of washing applications, such as automobiles, buildings' wall surfaces, bottles and dishes. The gas may include a pressurized air, a heated high-temperature gas and a high-temperature high-pressure gas such as steam. The cleaning liquid may use water such as tap water and an appropriate liquid mixed, as required, with additives such as surfactant to improve a cleaning performance and a sterilizing power. The cleaning liquid may have a pressure similar to that of the tap water but pressurizing it further to an appropriate level can produce a stronger cleaning action. Further, it is possible to mix appropriate powder of abrasive cleansing material such as sodium hydrogencarbonate and alumina into the flow upstream of the gas ejection port. In this case, a small amount of liquid, containing water and appropriate additives, is also supplied along with the powder to prevent the clogging of passage due to powder. The state of a gas-liquid mixture flow ejected from the cleaning nozzle can be adjusted by the actual dimensions of parts of the nozzle and the conditions under which to introduce the gas and cleaning liquid. A major state of the mixture consists of a large amount of pressurized gas as a main body and an appropriate amount of liquid added to it, and the liquid droplets formed by mixing the gas and the liquid can be set to any size, from atomized fine droplets to large droplets, according to the cleaning requirements by adjusting the amount of cleaning liquid ejected. As to the gas ejection port, it may be constructed in the form of a plurality of hole portions arranged in a ring, as well as in the form of a ring-shaped gap as described in the following embodiment. As to the cleaning liquid ejection port, too, it may be constructed in the form of a single hole portion as described in the following embodiment and in the form of a plurality of hole portions.

Further, while the droplet ejection speed may be increased to a sonic or supersonic speed, the droplets may be ejected at speeds below the sonic speed.

As to the shape of the trumpet-like portion, it is possible to adopt a trumpet-shaped portion defined by two or more inclined portions if the trumpet-shaped portion can be formed along some of multiple inclined portions and the gas ejection port can be opened into an intermediate part of the trumpet-shaped portion and if it is possible to interpose between the gas ejection port and the minimum diameter portion an inclined portion whose inclination angle with respect to the axis of the ejection nozzle portion is smaller than the ejection angle of the gas ejection port. It is also possible to form the trumpet-shaped portion by a curved surface. As to the shape of the gas-liquid mixture flow passage downstream of the minimum diameter portion of the ejection nozzle portion, it may be formed of a straight tube with a constant diameter or a tapered tube with its inner diameter progressively increasing or decreasing downstream. When a converging-diverging nozzle with its inner diameter on the downstream side progressively expanding toward the downstream end is employed, the so-called speed increasing effect of a tapered portion of the Laval nozzle can be taken advantage of to increase the ejection speed of the gas-liquid mixture flow from the ejection nozzle portion to a sonic or supersonic speed. A practical size for the diameter of the minimum diameter portion of the converging-diverging nozzle portion as the ejection nozzle portion is about 6–16 mm. An appropriate length from the liquid ejection port to the front end or downstream end of the ejection nozzle portion is about 10–50 times the diameter of the minimum diameter portion. As to the inclination of the tapered portion formed downstream of the minimum diameter portion, the inclination of only 1–2 degrees is enough for producing a satisfactory high-speed jet flow. Setting the inclination equal to or smaller than about 8 degrees can avoid a delamination of a boundary layer, the phenomenon that can easily occur in the gas-liquid mixture flow. Further, the cross section of a passage in the trumpet-shaped portion and the ejection nozzle portion is not limited to the circular one but it may be formed flat or elliptical. The inner surface of the trumpet-shaped portion that constitutes the gas ejection port and the outer surface of the cleaning liquid ejection portion may be formed of a plurality of stepped inclined surfaces or of a curved surface. A passage for the gas-liquid mixture flow downstream of the minimum diameter portion may be formed by combining a tapered portion and a straight tube portion.

Figure 2:
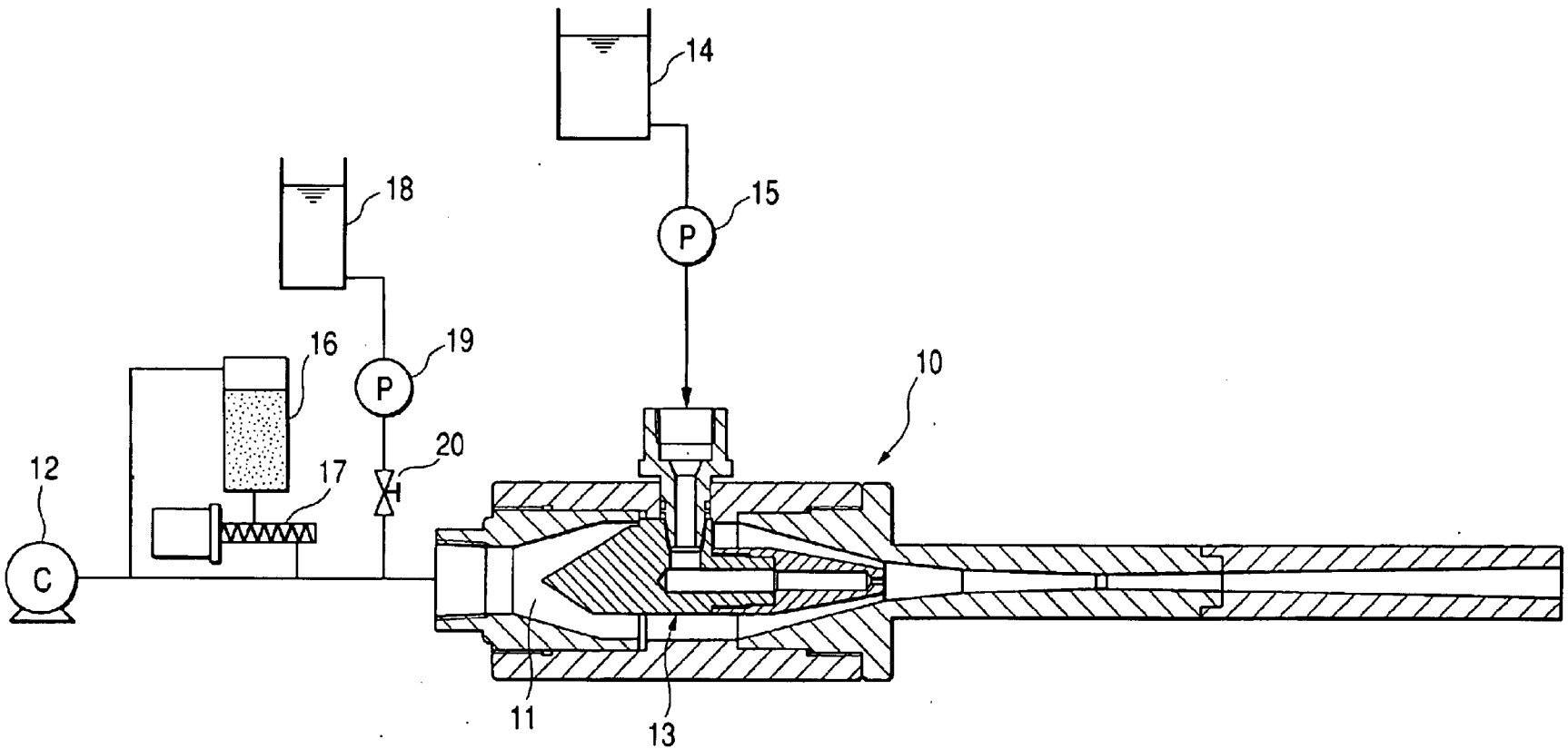
FIG. 2 shows a circuit configuration schematically showing an example application of the invention.

Now, embodiments of this invention will be described by referring to the accompanying drawings. FIG. 2 is a circuit diagram schematically showing an example application of this invention. In the figure, reference number 10 represents a cleaning nozzle, which has a passage 11 for pressurized gas formed inside thereof. The passage 11 is connected at its inlet portion with a pressurized gas supply means consisting of a compressor 12. Inside the passage 11 is provided a cleaning liquid supply portion 13 around which is formed a gas flowing gap. An inlet portion of the cleaning liquid supply portion 13 is connected to a cleaning liquid tank 14 and a pump 15. In this embodiment, the compressor 12 is connected on the downstream side with a powder supply means comprising a powder tank 16 and a feeding device 17 such as screw conveyor. Further downstream, the compressor 12 is also connected through a valve 20 with a clogging prevention water tank 18 for washing away powder adhering to the passage and with a pump 19. In this case, a check valve may be installed between the pump 19 and the valve 20 to prevent a backflow to the pump. These powder supply means and the liquid supply means for preventing clogging may be omitted as desired.

Figure 3:
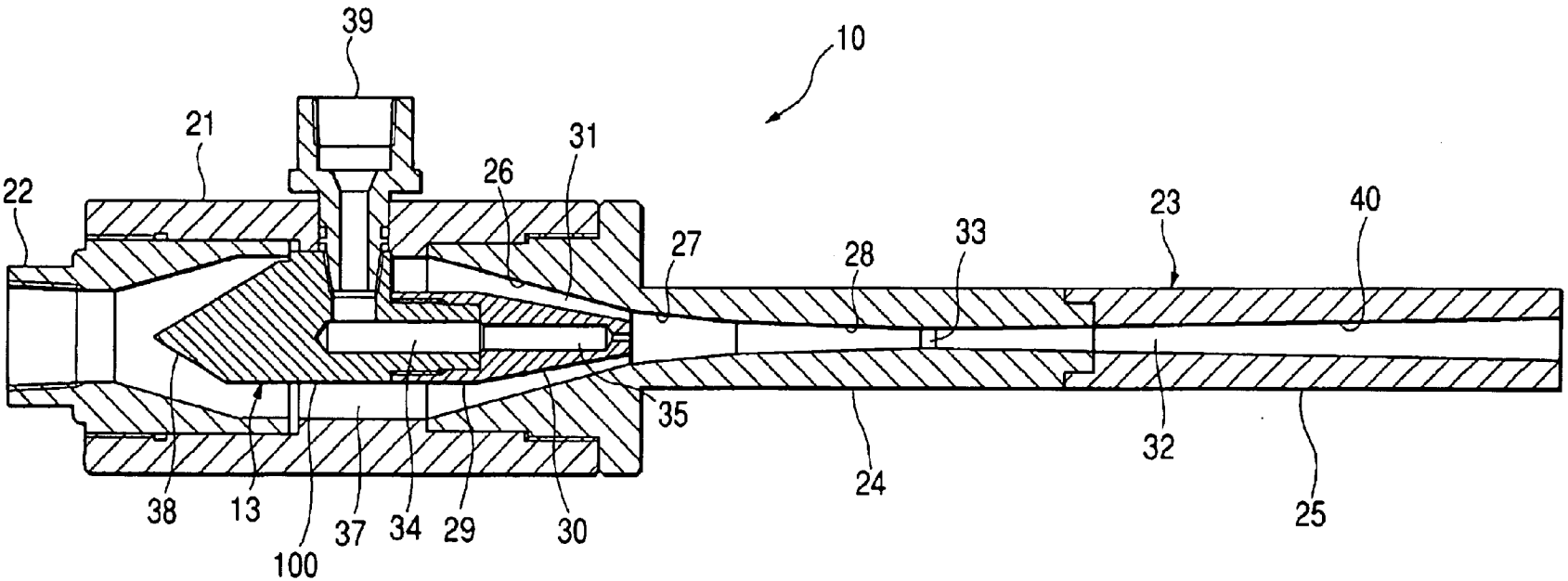
FIG. 3 shows a longitudinal cross section of an embodiment of the invention.
Figure 4:
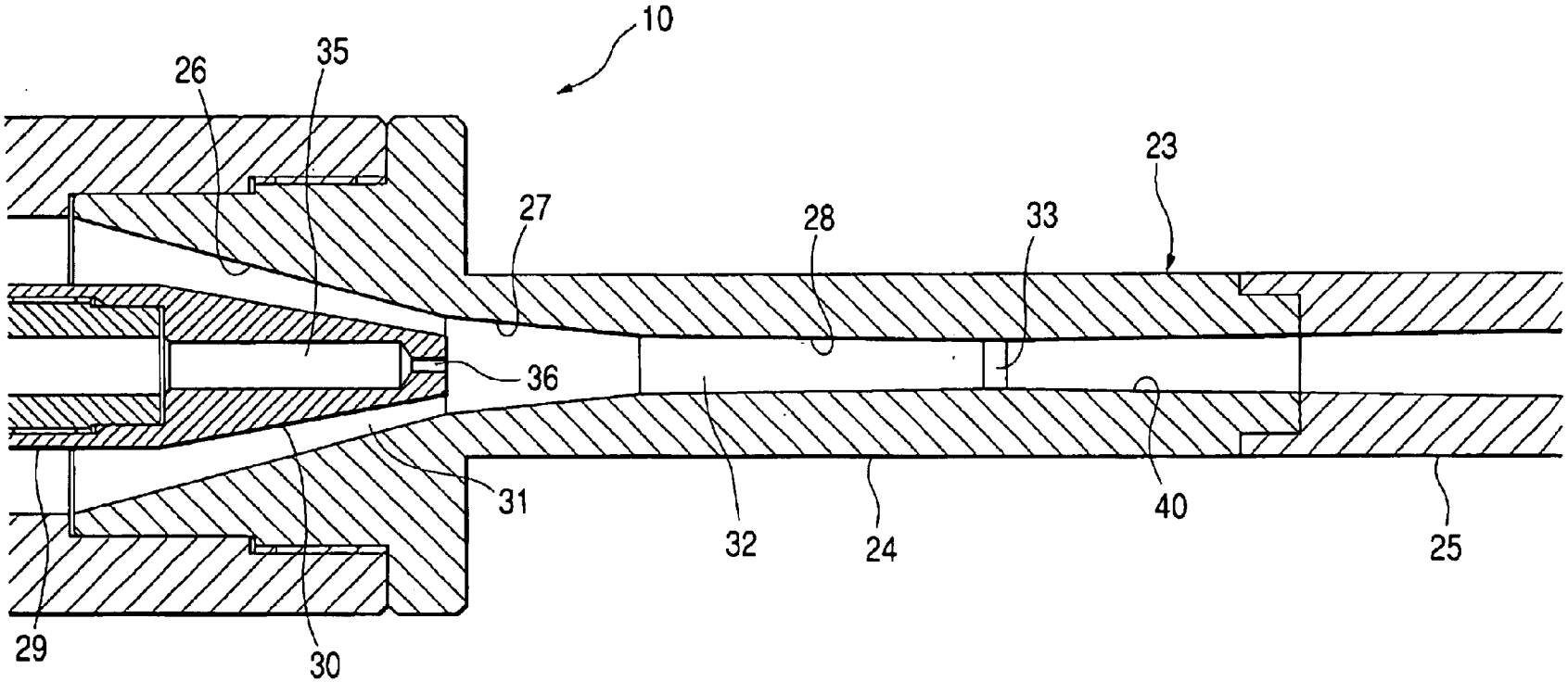
FIG. 4 shows a partial enlarged cross section showing an essential part of the embodiment shown in FIG. 3.

Next, the cleaning nozzle 10 will be described. FIG. 3 is a longitudinal cross section of the cleaning nozzle 10 according to an embodiment of this invention. FIG. 4 is an enlarged view of the nozzle. As shown in the figure, the cleaning nozzle 10 of this embodiment comprises a cylindrical body portion 21, the cleaning liquid supply portion 13 installed inside the cylindrical body portion 21, a gas introducing portion 22 screwed into an upstream part of the cylindrical body portion 21, and an ejection nozzle portion 23 as a converging-diverging nozzle portion screwed into a downstream part of the cylindrical body portion 21. The cleaning liquid supply portion 13 comprises an accumulating portion 100 and an ejection portion 29 screwed over a downstream part of the accumulating portion 100. The ejection nozzle portion 23 in this embodiment comprises a first nozzle member 24 formed integral with a trumpet-shaped portion and a second nozzle member 25 tapered so that its passage progressively expands toward the downstream end. These first and second nozzle members are joined together to shape the ejection nozzle portion 23 into a long converging-diverging nozzle portion. The first nozzle member 24 has its inclined portion formed by three tapered portions 26–28 whose diameter progressively decreases downstream. A gas ejection port 31 is formed between the most upstream tapered portion 26 and a tapered portion 30 formed on the outer surface of the ejection portion 29 of the cleaning liquid supply portion 13 so that the gas jet flow converges at a point upstream of a minimum diameter portion 33 of a passage 32. In this embodiment, the gap between the tapered portions 26 and 30 is progressively narrowed toward its downstream open end by differentiating the inclination angles of these tapered portions so that the cross-sectional area of the gas ejection port 31 perpendicular to the axis is reduced progressively to further accelerate the pressurized gas as it passes through the gas ejection port 31. When a powder material is supplied, the powder is accelerated along with the gas in the gas ejection port 31 and, after being ejected from the open end, is further accelerated like the liquid droplets.

Inside the accumulating portion 100 of the cleaning liquid supply portion 13 is formed an accumulating space 34 for the cleaning liquid. An outer wall surface of an upstream part of the accumulating portion 100 forms a tapered guide surface 38. Formed inside the ejection portion 29 is a passage 35 which communicates with the accumulating space 34 and is formed at its front end portion with a cleaning liquid ejection port 36, as shown in FIG. 4. In the above construction, the cleaning liquid pressurized by the pump 15 is ejected from the cleaning liquid ejection portion 29 at high speed. In the figure, reference number 39 denotes a cleaning liquid introducing portion connected to the accumulating space 34.

As shown in FIG. 3, between the inner surface of the cylindrical body portion 21 and the outer surface of the cleaning liquid supply portion 13 is formed a gap portion 37 that constitutes a passage 11 for gas and communicates with the ejection nozzle portion 23.

In this embodiment, as described above, because the trumpet-shaped portion is formed by three tapered portions 26–28 whose diameter is progressively reduced downstream, because the gas jet flow from the gas ejection port 31, which is formed between the most upstream tapered portion 26 and the tapered portion 30 formed on the outer surface of the ejection portion 29 of the cleaning liquid supply portion 13, is made to converge at a point upstream of the minimum diameter portion 33 of the passage 32, and because the cross-sectional area of the gas ejection port 31 perpendicular to the axis is made to decrease progressively, the liquid droplets are generated and accelerated at the trumpet-shaped portion in a very good condition. That is, first, because the cross-sectional area of the gas ejection port 31 perpendicular to the axis direction is progressively reduced, the pressurized gas is accelerated in the gas ejection port 31 and a high-speed gas flow is ejected along the trumpet-shaped portion. Further, because the trumpet-shaped portion is formed by the three tapered portions 26–28 and a progressively throttled, wide mixing space is formed upstream of the minimum diameter portion 33, the gas flow mixes well with the cleaning liquid from the cleaning liquid ejection port 36, generating uniform droplets and at the same time accelerating them. Further, since the gas jet flow from the gas ejection port 31 is made to converge at a point upstream of the minimum diameter portion 33, the liquid droplets that are mixed well with the gas highly uniformly are generated upstream of the minimum diameter portion 33. As the droplets pass through a downstream-expanding tapered portion 40, which is continuously formed in the first nozzle member 24 downstream of the minimum diameter portion 33 and in the second nozzle member 25, they are subjected to the speed increasing action of the converging-diverging nozzle to form a very powerful, uniform droplet jet flow.

Next, two features of the invention different from the aforementioned point of view will be explained. The first feature is that a gas ejection port like the gas ejection port 31 is formed along the trumpet-shaped portion of the ejection nozzle portion 23, i.e., in this embodiment, along the tapered portion 26 located most upstream among the tapered portions 26–28 that constitute the trumpet-shaped portion, and that the downstream open end of the gas ejection port 31 is formed in the trumpet-shaped portion. Further, the speed of gas ejected from the gas ejection port 31 is set higher than that of the cleaning liquid so that the high-speed pressurized gas flow ejected from the gas ejection port 31 converges along the tapered portion 26 toward a central portion, mixing with the cleaning liquid ejected form the cleaning liquid ejection port 36 to form liquid droplets, which are accelerated by the energy of the pressurized gas as the energy is transferred to the droplets. The second feature is that the minimum diameter portion 33 of a gas-liquid mixture flow passage 32 in the ejection nozzle portion 23 is formed at a point that communicates with the tapered portion 28 located most downstream in the trumpet-shaped portion, and that the portion downstream of the minimum diameter portion 33 is formed as a tapered portion 40 progressively expanding toward the downstream end. That is, the part of the ejection nozzle portion 23 upstream of the minimum diameter portion 33 of the gas-liquid mixture flow passage 32 is formed as a trumpet-shaped portion and the part downstream of the minimum diameter portion 33 is formed as a tapered portion gradually expanding toward the downstream end. With this construction, the liquid droplets ejected from the tapered portion 40 can be accelerated to a sonic or supersonic speed by the speed increasing effect of the Laval nozzle. In the subsonic speed, too, this construction has advantages of reducing a loss caused by the nozzle wall and therefore minimizing a deceleration of the gas-liquid mixture and thus contributes to the high-speed ejection of liquid droplets.

This invention has the two features as described above which combine to offer the capability of ejecting uniformly distributed liquid droplets at high speed with good stability. That is, according to the first feature, the gas flow ejected from the gas ejection port 31, which extends along the tapered portion 26 forming a part of the trumpet-shaped portion, converges along the inclined surface of the tapered portion 26 toward the central portion, mixing with the cleaning liquid ejected from the ejection port 36 to form liquid droplets, which are effectively accelerated by the energy of the pressurized gas as the energy is transferred to the liquid droplets. Then, according to the second feature, the accelerated flow of liquid droplets is throttled by the minimum diameter portion 33—which communicates with the tapered portion 28 of the trumpet-shaped portion—and is accelerated further as it passes through the downstream expanding tapered portion 40 before being ejected out at high speed. By utilizing the speed increasing effect of the Laval nozzle described above that is produced when the liquid droplet flow passes through the downstream expanding tapered portion 40, the ejection speed of the droplets can be increased to a sonic or supersonic speed. Because a powerful, highly uniform flow of liquid droplets can be produced stably, this invention can improve the cleaning action and is particularly effective in washing sticking dirt. Although the gas and the cleaning liquid are effectively mixed in the trumpet-shaped portion upstream of the minimum diameter portion 33 as described above, they of course continue to be mixed also in the tapered portion 40 downstream. The mixing action therefore is performed by both of the upstream and downstream portions. In the above embodiment, although the first nozzle member 24 of the ejection nozzle portion 23 is formed separate from the cylindrical body portion 21, they may be formed integral.

In this embodiment, because the gas flow ejected from the gas ejection port 31 converges upstream of the minimum diameter portion 33 of the passage 32 as described above, the mixing space in the trumpet-shaped portion can be made large, producing a good mixing action immediately upstream of the minimum diameter portion 33. Further, if the cross-sectional area of the passage at the downstream open end of the gas ejection port 31 is set almost equal to or slightly smaller than the cross-sectional area of the minimum diameter portion 33, for example, at an area ratio between the passage and the minimum diameter portion of about 1:1 to 1:1.3, the reduction in the flow speed can be minimized throughout the entire passage, producing a high-speed, stable gas-liquid mixture flow. For example, a practical size of the diameter of the minimum diameter portion 33 of the ejection nozzle portion 23 is approximately 6–16 mm. An appropriate length from the cleaning liquid ejection port 36 to the free end or downstream end of the ejection nozzle portion 23 is about 10–50 times the diameter of the minimum diameter portion 33. As to the inclination of the tapered portion 40 formed downstream of the minimum diameter portion 33, the inclination of only 1–2 degrees is enough for producing a satisfactory high-speed jet flow. Setting the inclination equal to or smaller than about 8 degrees can avoid a delamination of a boundary layer, the phenomenon that can easily occur in the gas-liquid mixture flow.

Figure 5:
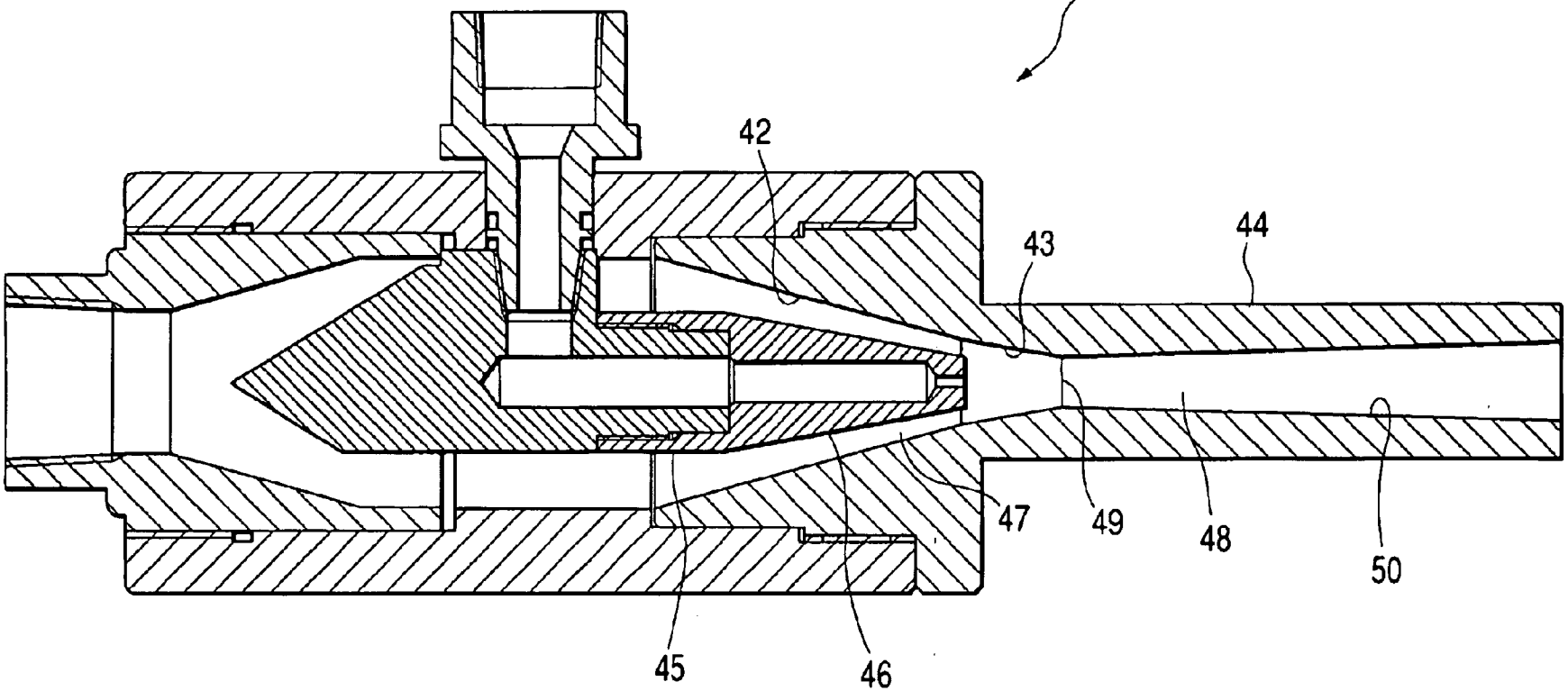
FIG. 5 shows a longitudinal cross section of another embodiment of the invention.
Figure 6:
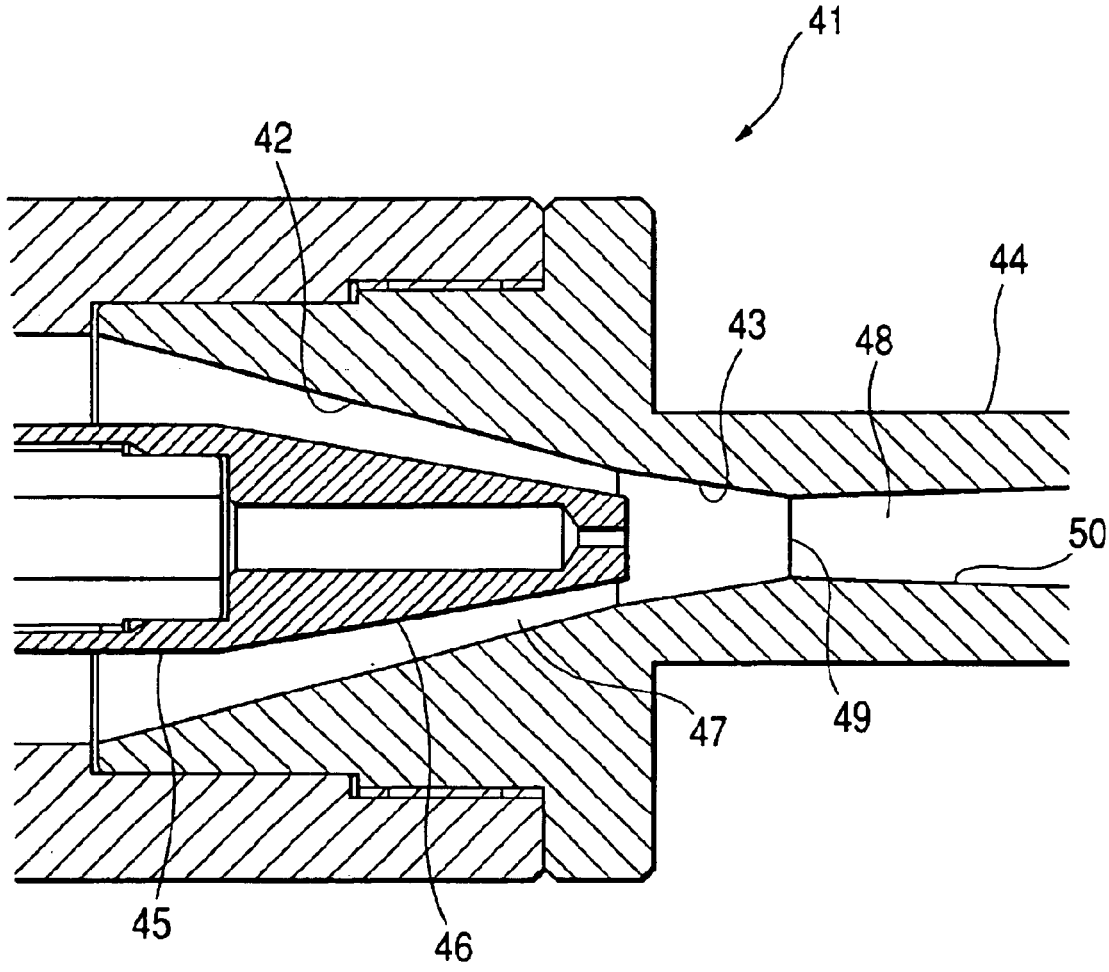
FIG. 6 shows a partial enlarged cross section showing an essential part of the embodiment shown in FIG. 5.

FIG. 5 shows a longitudinal cross section of another embodiment of the invention. FIG. 6 is an enlarged cross section of an essential part of FIG. 5. While the cleaning nozzle 10 of the previous embodiment has the trumpet-shaped portion formed by three tapered portions 26–28, a cleaning nozzle 41 of this embodiment has the trumpet-shaped portion formed by using two tapered portions 42, 43. Further, while the ejection nozzle portion 23 of the cleaning nozzle 10 is formed of two members, an ejection nozzle portion 44 of the cleaning nozzle 41 of this embodiment is formed of a single member. A gas ejection port 47 formed between the tapered portion 42 and a tapered portion 46 of a cleaning liquid ejection portion 45 is so formed that its cross-sectional area perpendicular to the axis direction progressively decreases toward its downstream open end, as in the cleaning nozzle 10. The downstream open end of the gas ejection port 47 is located almost at a boundary between the two tapered portions 42, 43. Further, the gas jet flow from the gas ejection port 47 is arranged to converge near a minimum diameter portion 49 of a passage 48. In this embodiment, too, the pressurized gas is accelerated in the gas ejection port 47 and mixed well with a cleaning liquid from the cleaning liquid ejection portion 45 in a wide mixing space formed immediately before the minimum diameter portion 49. In this space uniformly mixed droplets are generated and at the same time accelerated. When the uniformly mixed droplets, which were generated near the minimum diameter portion 49, passes through a downstream-expanding tapered portion 50 formed downstream of the minimum diameter portion 49, they are subjected to the speed increasing action of the converging-diverging nozzle and formed into a powerful, uniform droplet jet flow.

Thus, in this embodiment, as in the previous embodiment, the cross-sectional area of the passage of the gas ejection port 47 perpendicular to its axis is progressively reduced toward the downstream open end so as to accelerate the gas in the trumpet-shaped portion. This construction, combined with a tapered portion 50 formed downstream of the minimum diameter portion 49, realizes the similar function to that of the previous embodiment.

Figure 7:
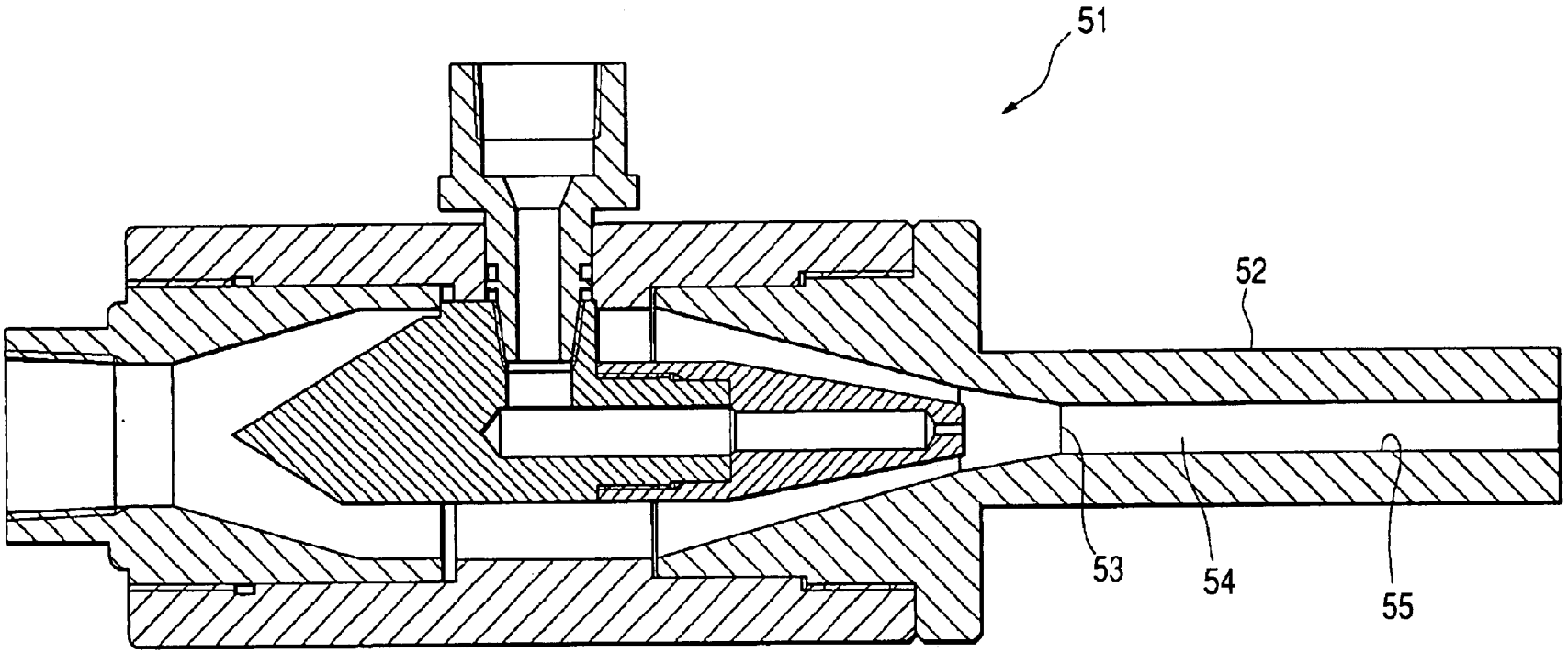
FIG. 7 shows a longitudinal cross section of a variation of the embodiment shown in FIGS. 5 and 6.

FIG. 7 is a longitudinal cross section of a variation of the second embodiment of FIG. 5. In a cleaning nozzle 51 of this embodiment, a passage 54 downstream of a minimum diameter portion 53 of an ejection nozzle portion 52 is formed of a straight tube portion 55 with a constant inner diameter. The cleaning nozzle 51 of this embodiment also has a gas-liquid mixing action, similar to that of the previous embodiment, in the trumpet-shaped portion upstream of the minimum diameter portion 53 and thus can generate uniform droplets.

Figure 8:
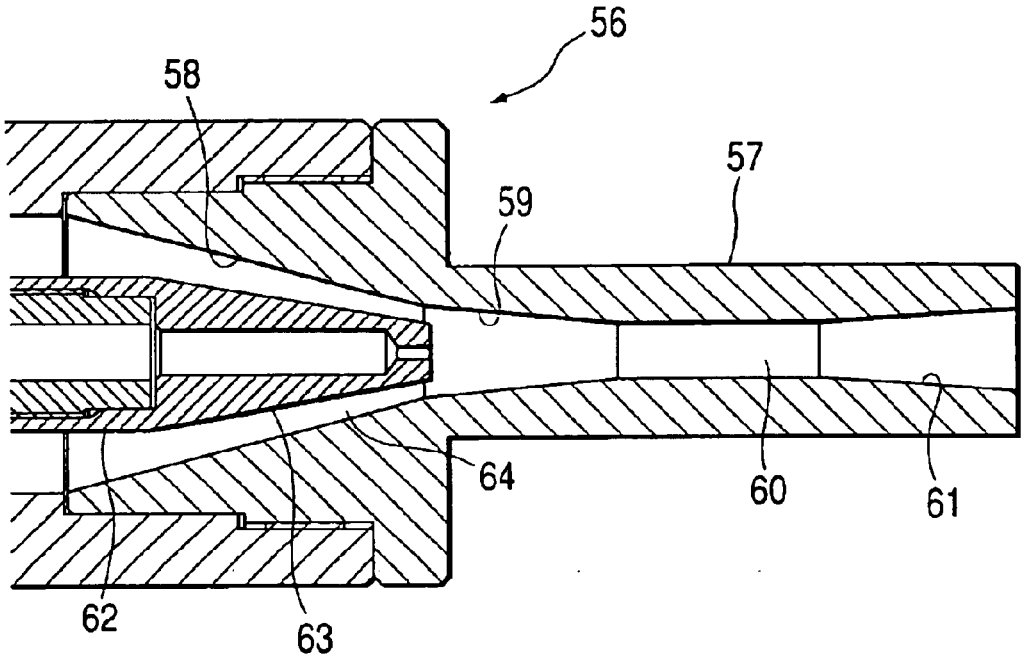
FIG. 8 shows a partial longitudinal cross section showing an essential part of still another embodiment of the invention.

FIG. 8 is a partial longitudinal cross section showing an essential part of still another embodiment of the invention. In a cleaning nozzle 56 of this embodiment, the trumpet-shaped portion of an ejection nozzle portion 57 is formed of two tapered portions 58, 59. A minimum diameter portion 60 located downstream of the trumpet-shaped portion is formed of a straight tube of a predetermined length. Downstream of the minimum diameter portion 60 is formed a passage having a tapered portion 61. In this embodiment, between a tapered portion 58 of the ejection nozzle portion 57 and a tapered portion 63 formed on the outer surface of a cleaning liquid ejection portion 62 is formed a gas ejection port 64, which ejects a gas jet flow that converges at a point upstream of the minimum diameter portion 60, thus producing a good gas-liquid mixing action.

Figure 9:
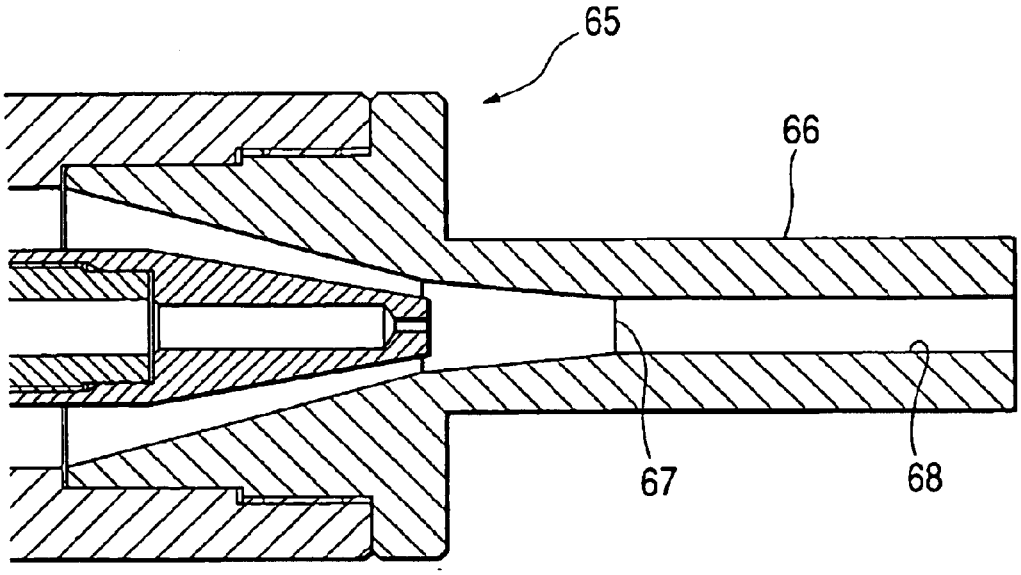
FIG. 9 shows a partial longitudinal cross section showing an essential part of a variation of the embodiment shown in FIG. 8.

FIG. 9 is a partial longitudinal cross section showing a variation of the embodiment of FIG. 8. A cleaning nozzle 65 of this embodiment has a straight tube portion 68 of a constant diameter downstream of a minimum diameter portion 67 of an ejection nozzle portion 66, instead of the tapered portion 61.

Figure 10:
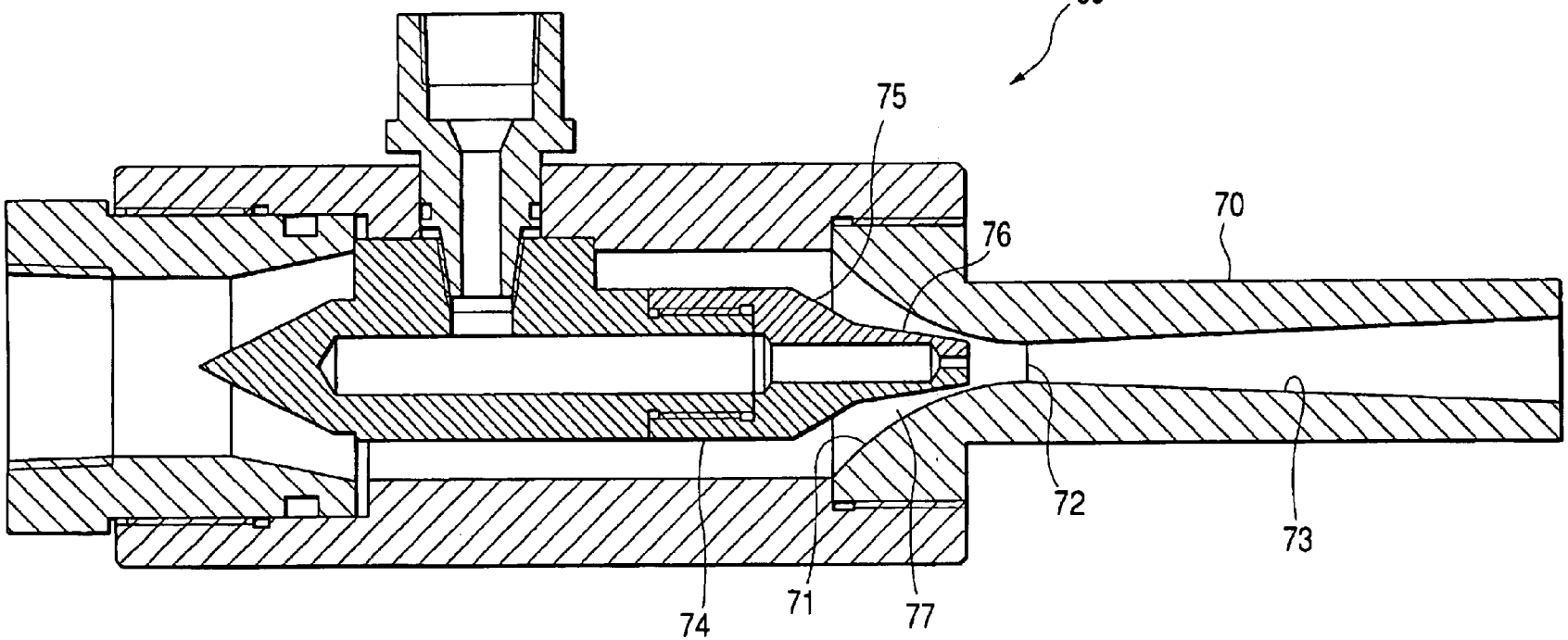
FIG. 10 shows a longitudinal cross section of a further embodiment of the invention.
Figure 11:
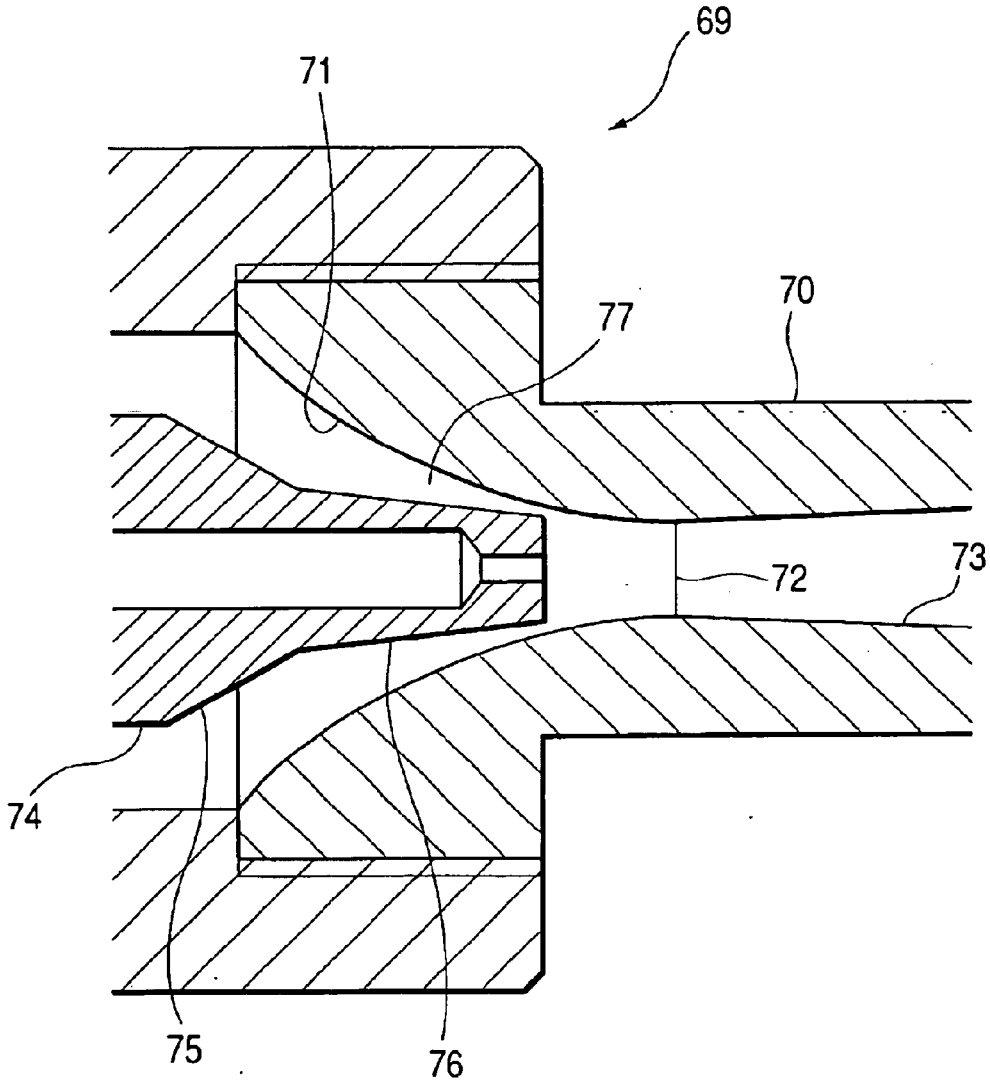
FIG. 11 shows a partial enlarged cross section showing an essential part of the embodiment shown in FIG. 10.

FIG. 10 is a longitudinal cross section of a further embodiment of this invention. FIG. 11 is a partial, enlarged cross section showing an essential part of FIG. 10. As shown in the figure, a cleaning nozzle 69 of this embodiment is characterized in that the trumpet-shaped portion at the upstream end of an ejection nozzle portion 70 is formed by a curved surface portion 71, that a minimum diameter portion 72 is formed at the downstream end of the trumpet-shaped portion, and that a downstream-expanding tapered portion 73 is formed downstream of the minimum diameter portion 72. That is, this embodiment uses the curved surface portion 71 as the trumpet-shaped portion of the ejection nozzle portion 70 and has a gas ejection port 77 formed between the curved surface portion 71 and tapered portions 75, 76 formed on the outer surface of a cleaning liquid ejection portion 74. The curved surface portion 71 situated between the gas ejection port 77 and the minimum diameter portion 72 is so formed that an inclination angle of its tangential line progressively decreases toward the minimum diameter portion 72, so that, as with the multiple inclined portions of FIG. 1, a focus onto which the gas jet flow ejected from the gas ejection port 77 converges is shifted upstream relative to the minimum diameter portion 72. This in turn increases the mixing space. This construction therefore can accelerate the gas-liquid mixing action at the trumpet-shaped portion and improve the uniformity of mixed state of cleaning liquid droplets, producing a stable, high-speed droplet jet flow. The cleaning liquid ejection portion 74 may also use a curved surface as its outer surface, rather than the tapered portions 75, 76.

Figure 12:
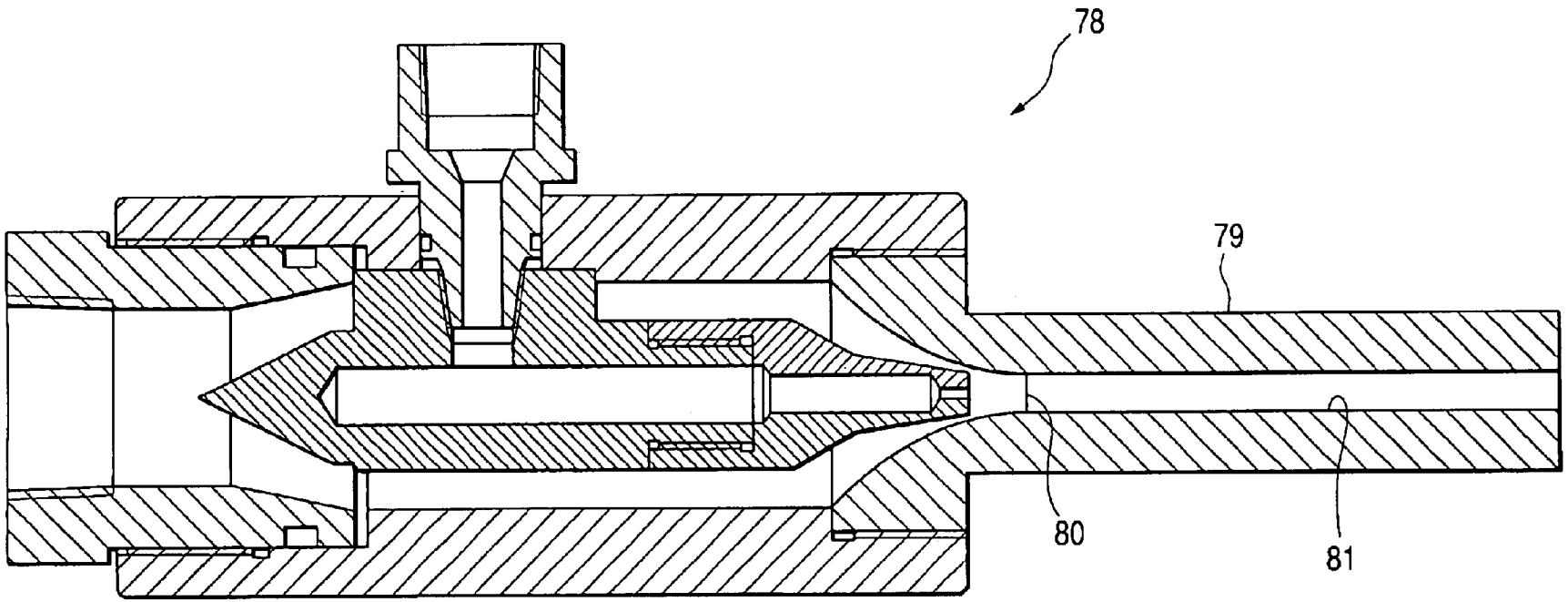
FIG. 12 shows a longitudinal cross section of a variation of the embodiment shown in FIGS. 10 and 11.

FIG. 12 is a longitudinal cross section of a variation of the embodiment of FIG. 10. A cleaning nozzle 78 of this embodiment uses, instead of the tapered portion 73, a straight tube portion 81 of a constant inner diameter for the passage downstream of a minimum diameter portion 80 of an ejection nozzle portion 79. This construction can also produce the similar gas-liquid mixing action to that of the previous embodiment.

Figure 13:
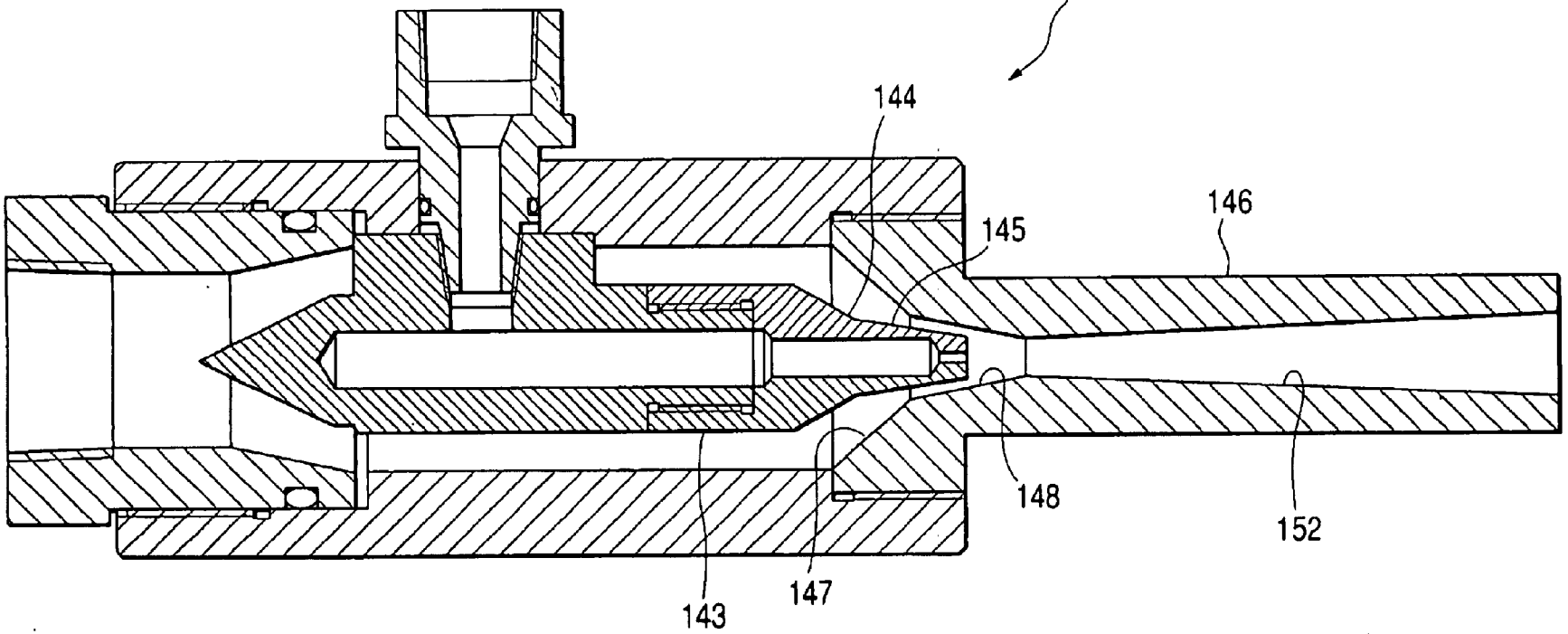
FIG. 13 shows a longitudinal cross section showing still another embodiment of the invention.
Figure 14:
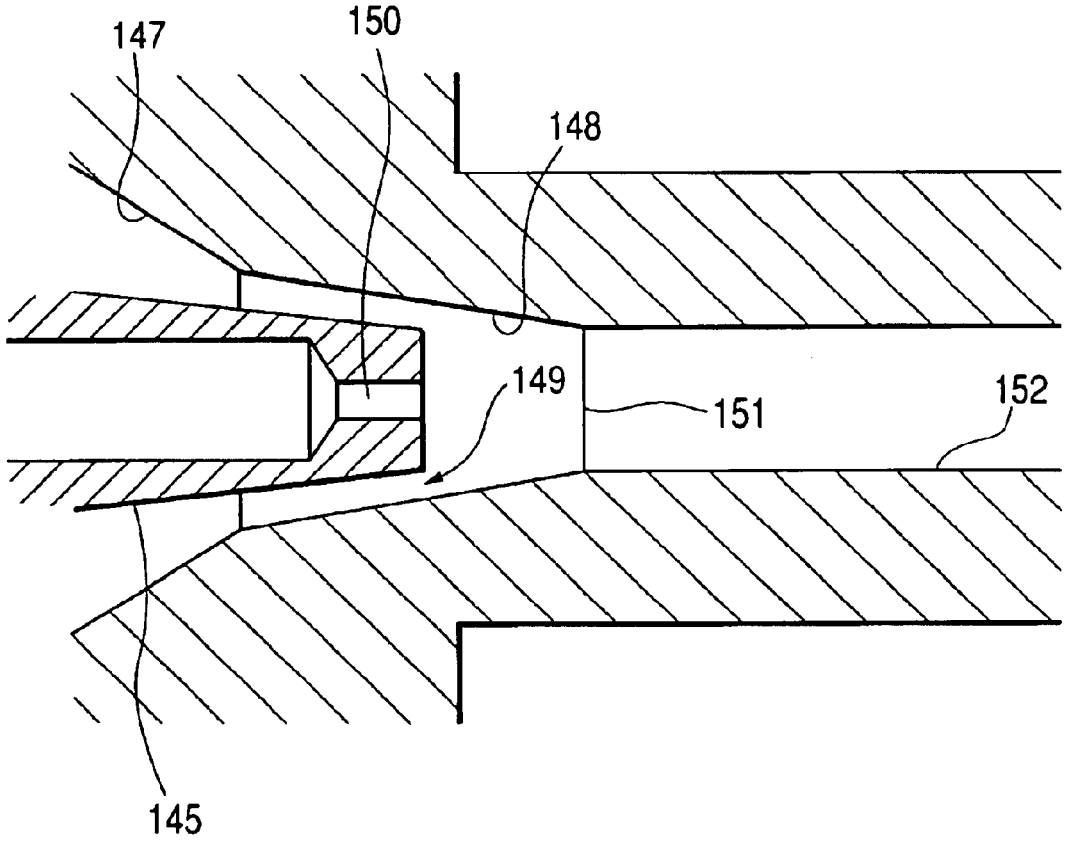
FIG. 14 shows an enlarged view showing an essential part of the embodiment shown in FIG. 13.

FIG. 13 shows a longitudinal cross section of a further embodiment of this invention. FIG. 14 is an enlarged view of an essential part of FIG. 13. In a cleaning nozzle 142 of this embodiment, a gas ejection port 149 is formed between two tapered portions 144, 145 formed on an outer surface of a cleaning liquid ejection portion 143 and a trumpet-shaped portion defined by two tapered portions 147, 148 formed at an upstream part of a conversing-diverging nozzle portion 146 so that the cross-sectional area of the passage decreases progressively. As shown in FIG. 14, the gas is ejected at high speed from the gas ejection port 149 between the tapered portion 145 and the tapered portion 148. The high-speed pressurized gas ejected from the gas ejection port 149 is accelerated at the trumpet-shaped portion as it is mixed with the cleaning liquid ejected from an ejection port 150 of the cleaning liquid ejection portion 143. The mixed gas-liquid flow is also subjected to accelerating and mixing actions of a tapered portion 152 downstream of a minimum diameter portion 151 of the conversing-diverging nozzle portion 146. These actions of the upstream trumpet-shaped portion and the downstream tapered portion 152 combine to produce the similar function to those of the previous embodiments.

Figure 15:
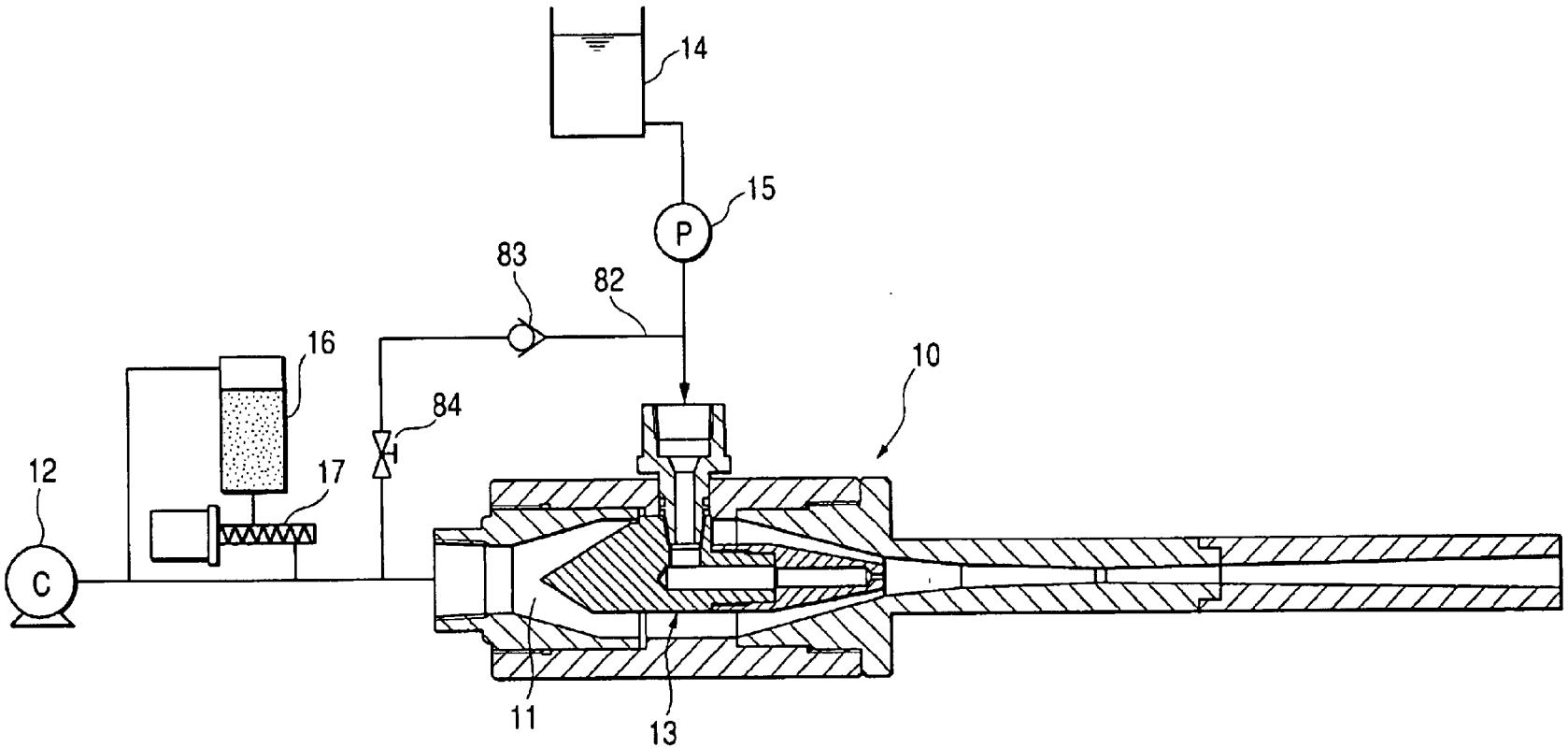
FIG. 15 shows a circuit configuration schematically showing a further embodiment for preventing the clogging due to powder.

FIG. 15 shows still another embodiment of a circuit for preventing clogging due to powder. This embodiment is a variation of the configuration shown in FIG. 2. This configuration, when compared with the previous configuration, is characterized in that the cleaning liquid supply circuit including a cleaning liquid tank 14 and a pump 15 is also used as a liquid supply circuit for preventing the clogging due to powder. That is, an appropriate cleaning liquid such as water is supplied to the cleaning nozzle 10 and also supplied as a clogging prevention liquid through a branch pipe 82 to an intermediate pressure gas flow passage between a powder injection portion connected to the powder feeding device 17 and the cleaning nozzle 10. In the figure, reference number 83 denotes a check valve for backflow prevention and 84 a valve. During the operation of the cleaning nozzle 10, i.e., while the feeding device 17 is injecting powder, the clogging prevention liquid is supplied through the branch pipe 82 to prevent the powder from adhering to the inner wall surface, particularly protrusions and stepped portions, of passages in devices such as the cleaning nozzle 10 and from clogging the passages. It is possible to make setting such that after the powder injection into the pressurized gas flow has stopped, the clogging prevention liquid continues to be supplied for a predetermined period to remove the residual powder. In that case, it is of course possible to install a valve (not shown) parallelly with the valve 84 in an intermediate portion of the cleaning liquid supply circuit between the cleaning nozzle 10 and a connection with the branch pipe 82. Further, instead of the above configuration, the pump 19 of FIG. 2 maybe omitted, as described in Unexamined Japanese Patent Publication No. Sho. 63-212469 for example, by utilizing the inner pressure of the pressurized gas flow itself in injecting the clogging prevention liquid.

In the above circuit configurations including the one of FIG. 2, the adjustment of the amount of the clogging prevention liquid can be made by the valve 20 or valve 84. In that case, the liquid may be supplied not just in a constant supply mode but also in an intermittent mode if necessary. An experiment was conducted to remove graffiti on a concrete wall by using sodium hydrogencarbonate particles as a powder material. In this experiment, 1 $m^3$/min of air at a pressure of 0.39 MPa was used as a pressurized gas flow, 10 1/min of water at 13 MPa as a cleaning liquid to be supplied to the cleaning nozzle, and 1 kg/min of sodium hydrogencarbonate as a powder material. In this experiment, 500 cc/min of water was used as the clogging prevention liquid. It was found that no sodium hydrogencarbonate particles as the powder material accumulated in the passage of the cleaning nozzle and that they reached the concrete in the form of particles and produced a satisfactory cleaning action.

The present invention provides the following advantages.

(1) An inclined portion with a small inclination angle is interposed between the minimum diameter portion and the gas ejection port, which is formed along the inclined portion making up the trumpet-shaped portion located immediately upstream of the minimum diameter portion of the ejection nozzle. Because of this arrangement, the focus onto which the gas jet flow from the gas ejection port converges is shifted upstream relative to the minimum diameter portion and the mixing space is expanded. This structure accelerates the gas-liquid mixing at the trumpet-shaped portion, producing a uniformly mixed, high-speed droplet jet flow and therefore a stable, powerful cleaning action.

(2) When the trumpet-shaped portion is formed by a curved surface, too, the tangent to the curved surface situated between the gas ejection port and the minimum diameter portion progressively reduces its inclination. Hence, the focus, onto which the gas-liquid mixture flow of the gas from the gas ejection port and the cleaning liquid from the inner ejection port converges, is shifted upstream relative to the minimum diameter portion. And at the same time the mixing space is expanded. As a result, the gas-liquid mixing at the trumpet-shaped portion is accelerated, improving the uniformity of distribution of the cleaning liquid droplets and realizing a table, powerful cleaning action.

(3) If the gas jet flow passing through the central part of the gas ejection port is made to converge upstream of the minimum diameter portion so that the gas-liquid mixture flow will converge slightly upstream of the minimum diameter portion, the gas-liquid mixing action at the trumpet-shaped portion can be further improved, making it possible to supply the droplets in a uniformly mixed state to the passage downstream of the minimum diameter portion. With the additional mixing in the downstream passage, the gas-liquid mixture flow can be transformed into a very uniform, stable droplet jet flow.

(4) If the cross-sectional area of the gas ejection port perpendicular to the axis direction is reduced progressively toward its downstream open end, the speed of the gas flow ejected onto an intermediate part of the trumpet-shaped portion is increased, further accelerating the gas-liquid mixing action.

(5) If the cross-sectional area of the gas ejection port at its downstream open end is set almost equal to or slightly smaller than that of the minimum diameter portion, i.e., the ratio between these cross-sectional areas is set to 1:1 to 1:1.3, then a reduction in the flow speed can be minimized throughout the entire passage, realizing a stable, high-speed gas-liquid mixture flow.

(6) If the distance from the cleaning liquid ejection port to the downstream end of the ejection nozzle portion is set 10–50 times the diameter of the minimum diameter portion, satisfactory mixing and acceleration actions can be produced in the trumpet-shaped portion and the ejection nozzle portion, which in turn forms a powerful cleaning medium flow of uniformly mixed, high-speed droplet jet.

(7) If a powder material is supplied to the passage upstream of the gas ejection port, the delamination action of the powder can further improve the cleaning performance, particularly for removing sticking dirt.

(8) If a small quantity of the clogging prevention liquid is supplied to a point in the pressurized gas passage between the powder injection portion and the cleaning nozzle, the clogging that might result when powder is supplied as the cleaning medium can be avoided. This is very effective in maintaining the cleaning nozzle performance.

(9) A stable clogging prevention effect can be obtained without impairing the ejection performance of the cleaning nozzle by setting the amount of the clogging prevention liquid supplied smaller than the amount of liquid supplied to the cleaning nozzle, by setting it smaller by weight than the amount of powder injected, or by setting it smaller by volume than 1/1000 the amount of the pressurized gas flow.

(10) If the clogging prevention liquid is made to continue to be supplied for a predetermined duration after the injection of powder into the pressurized gas flow has stopped, it is possible to thoroughly remove the powder remaining after the nozzle operation.

(11) Because the gas ejection port is formed along the trumpet-shaped portion, the gas jet flow converges into the central portion as it is effectively mixed with the cleaning liquid and at the same time the liquid droplets formed by the gas-liquid mixing action can be accelerated. Further, the synergistic effect of actions—the gas-liquid mixing and acceleration by the trumpet-shaped portion formed upstream of the minimum diameter portion of the ejection nozzle portion (converging-diverging nozzle portion) and the liquid droplet mixing and acceleration by the speed increasing phenomenon of the Laval nozzle at the tapered portion located downstream of the minimum diameter portion—can stably produce a powerful, uniformly distributed liquid droplet flow with a simple nozzle structure. This invention therefore is very effective in improving a cleaning performance particularly for removing sticking dirt.

(12) Because the converging-diverging nozzle is employed, the speed increasing effect of the Laval nozzle can be utilized to increase the cleaning nozzle ejection speed to a sonic or supersonic speed.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

Further, the dependencies of the claims are preliminary: It is explicitly stated that any combinations of claimed features and/or of features described in the description is intended to be claimed, if appropriate in the course of the grant procedure.

What is claimed is:

1. A cleaning nozzle comprising:

an ejection nozzle portion having a minimum diameter portion and a trumpet-shaped portion formed by multiple inclined portions located upstream of said minimum diameter portion;

a gas ejection port formed along said multiple inclined portions and opened to an intermediate part of said trumpet-shaped portion;

another inclined portion having its inclination angle with respect to an axis of said ejection nozzle portion smaller than an ejection angle of said gas ejection port and interposed between said gas ejection port and said minimum diameter portion; and a cleaning liquid ejection port formed inside said gas ejection port;

whereby a gas is ejected from said gas ejection port at a speed higher than that of a cleaning liquid from said cleaning liquid ejection port to transform the cleaning liquid into droplets and to accelerate them.

2. A cleaning nozzle according to claim 1, wherein a gas jet flow passing through a central part of said gas ejection port converges at a point upstream of said minimum diameter portion.

3. A cleaning nozzle according to claim 1, wherein a cross-sectional area of said gas ejection port perpendicular to a direction of its axis is progressively reduced toward its downstream open end to accelerate the gas.

4. A cleaning nozzle according to claim 1, wherein a cross-sectional area of said gas ejection port at its downstream open end is set almost equal to or slightly smaller than that of said minimum diameter portion.

5. A cleaning nozzle according to claim 1, wherein a ratio between a cross-sectional area of said gas ejection port at its downstream open end and a cross-sectional area of the minimum diameter portion is set to 1:1 to 1:1.3.

6. A cleaning nozzle according to claim 1, wherein a distance from said cleaning liquid ejection port to a downstream end of said ejection nozzle portion is 10–50 times a diameter of said minimum diameter portion.

7. A cleaning nozzle according to claim 1, wherein a powder material can be supplied to an upstream side of said gas ejection port.

8. A cleaning nozzle according to claim 1, wherein a pressurized gas flow passage feeds into the cleaning nozzle for allowing a small amount of clogging prevention liquid to be injected into an intermediate section of the pressurized gas flow passage between a powder injection portion and the cleaning nozzle.

9. A cleaning nozzle according to claim 1, wherein the amount of the clogging prevention liquid is smaller than that of liquid supplied to the cleaning nozzle.

10. A cleaning nozzle according to claim 1, wherein the amount of the clogging prevention liquid is smaller by weight than that of the powder injected.

11. A cleaning nozzle according to claim 1, wherein the amount of the cleaning prevention liquid is smaller by volume than $1/1000$ that of the pressurized gas flow.

12. A cleaning nozzle according to claim 1, wherein the clogging prevention liquid is made to continue to be injected for a predetermined period after the injection of powder into the pressurized gas flow has stopped.

13. A cleaning nozzle according to claim 1, wherein the inclined portions of the trumpet-shaped portion are inclined in the axial direction of the nozzle.

14. A cleaning nozzle comprising: an ejection nozzle portion having a minimum diameter portion and a trumpet-shaped portion formed by a curved surface located upstream of said minimum diameter portion, an inclination angle of a tangent to the curved surface progressively decreasing toward said minimum diameter portion; a gas ejection port formed along the curved surface and opened to an intermediate part of said trumpet-shaped portion; and a cleaning liquid ejection port formed inside said gas ejection port; whereby a gas is ejected from said gas ejection port at a speed higher than that of a cleaning liquid from said cleaning liquid ejection port to transform the cleaning liquid into droplets and to accelerate them, wherein a tapered portion is formed on an outer surface of the cleaning liquid ejection port.

15. A cleaning nozzle according to claim 14, wherein a cross-sectional area of said gas ejection port perpendicular to a direction of its axis is progressively reduced toward its downstream open end to accelerate the gas.

16. A cleaning nozzle according to claim 14, wherein a distance from said cleaning liquid ejection port to a downstream end of said ejection nozzle portion is 10–50 times a diameter of said minimum diameter portion.

17. A cleaning nozzle according to claim 14, wherein a powder material can be supplied to an upstream side of said gas ejection port.

18. A cleaning nozzle according to claim 14, wherein the curved surface of the trumpet-shaped portion is curved in the axial direction of the nozzle.

19. A cleaning nozzle comprising: an ejection nozzle portion having a minimum diameter portion and a trumpet-shaped portion formed by a curved surface located upstream of said minimum diameter portion, an inclination angle of a tangent to the curved surface progressively decreasing toward said minimum diameter portion; a gas ejection port formed along the curved surface and opened to an intermediate part of said trumpet-shaped portion; and a cleaning liquid ejection port formed inside said gas ejection port; whereby a gas is ejected from said gas ejection port at a speed higher than that of a cleaning liquid from said cleaning liquid ejection port to transform the cleaning liquid into droplets and to accelerate them, wherein a gas jet flow passing through a central part of said gas ejection port converges at a point upstream of said minimum diameter portion.

20. A cleaning nozzle comprising: an ejection nozzle portion having a minimum diameter portion and a trumpet-shaped portion formed by a curved surface located upstream of said minimum diameter portion, an inclination angle of a tangent to the curved surface progressively decreasing toward said minimum diameter portion; a gas ejection port formed along the curved surface and opened to an intermediate part of said trumpet-shaped portion; and a cleaning liquid ejection port formed inside said gas ejection port; whereby a gas is ejected from said gas ejection port at a speed higher than that of a cleaning liquid from said cleaning liquid ejection port to transform the cleaning liquid into droplets and to accelerate them, wherein a cross-sectional area of said gas ejection port at its downstream open end is set almost equal to or slightly smaller than that of said minimum diameter portion.

21. A cleaning nozzle comprising: an ejection nozzle portion having a minimum diameter portion and a trumpet-shaped portion formed by a curved surface located upstream of said minimum diameter portion, an inclination angle of a tangent to the curved surface progressively decreasing toward said minimum diameter portion; a gas ejection port formed alone the curved surface and opened to an intermediate part of said trumpet-shaped portion; and a cleaning liquid ejection port formed inside said gas ejection port; whereby a gas is ejected from said gas ejection port at a speed higher than that of a cleaning liquid from said cleaning liquid ejection port to transform the cleaning liquid into droplets and to accelerate them, wherein a ratio between a cross-sectional area of said gas ejection port at its downstream open end and a cross-sectional area of the minimum diameter portion is set to 1:1 to 1:1.3.

22. A cleaning nozzle comprising:

a converging-diverging nozzle portion having a minimum diameter portion and a trumpet-shaped portion formed upstream of said minimum diameter portion;

a gas ejection port formed along said trumpet-shaped portion and opened into an intermediate part of said trumpet-shaped portion; and a cleaning liquid ejection port formed inside said gas ejection port;

whereby a gas is ejected at a higher speed than that of a cleaning liquid to transform the cleaning liquid into droplets and the droplets are further accelerated downstream of these ejection ports before being ejected out from the cleaning nozzle, wherein a tapered portion is formed on an outer surface of the cleaning liquid ejection port.

23. A cleaning nozzle according to claim 22, wherein a gas jet flow passing through a central part of said gas ejection port converges at a point upstream of said minimum diameter portion.

24. A cleaning nozzle according to claim 22, wherein a cross-sectional area of said gas ejection port perpendicular to a direction of its axis is progressively reduced toward its downstream open end to accelerate the gas.

25. A cleaning nozzle according to claim 22, wherein a distance from said cleaning liquid ejection port to a downstream end of said ejection nozzle portion is 10–50 times a diameter of said minimum diameter portion.

26. A cleaning nozzle according to claim 22, wherein a powder material can be supplied to an upstream side of said gas ejection port.

27. A cleaning nozzle according to claim 22, wherein a pressurized gas flow passage feeds into the cleaning nozzle for allowing a small amount of clogging prevention liquid to be injected into an intermediate section of the pressurized gas flow passage between a powder injection portion and the cleaning nozzle.

28. A cleaning nozzle according to claim 22, wherein the amount of the clogging prevention liquid is smaller than that of liquid supplied to the cleaning nozzle.

29. A cleaning nozzle according to claim 22, wherein the amount of the clogging prevention liquid is smaller by weight than that of the powder injected.

30. A cleaning nozzle according to claim 22, wherein the amount of the cleaning prevention liquid is smaller by volume than 1/1000 that of the pressurized gas flow.

31. A cleaning nozzle according to claim 22, wherein the clogging prevention liquid is made to continue to be injected for a predetermined period after the injection of powder into the pressurized gas flow has stopped.

32. A cleaning nozzle according to claim 22, wherein the converging-diverging nozzle portion has a converging-diverging shape in the axial direction of the nozzle.

33. A cleaning nozzle comprising:

a converging-diverging nozzle portion having a minimum diameter portion and a trumpet-shaped portion formed upstream of said minimum diameter portion;

a gas ejection port formed along said trumpet-shaped portion and opened into an intermediate part of said trumpet-shaped portion; and a cleaning liquid ejection port formed inside said gas ejection port;

whereby a gas is ejected at a higher speed than that of a cleaning liquid to transform the cleaning liquid into droplets and the droplets are further accelerated downstream of these ejection ports before being ejected out from the cleaning nozzle, wherein a cross-sectional area of said gas ejection port at its downstream open end is set almost equal to or slightly smaller than that of said minimum diameter portion.

34. A cleaning nozzle comprising:

a converging-diverging nozzle portion having a minimum diameter portion and a trumpet-shaped portion formed upstream of said minimum diameter portion;

a gas ejection port formed along said trumpet-shaped portion and opened into an intermediate part of said trumpet-shaped portion; and a cleaning liquid ejection port formed inside said gas ejection port;

whereby a gas is ejected at a higher speed than that of a cleaning liquid to transform the cleaning liquid into droplets and the droplets are further accelerated downstream of these ejection ports before being ejected out from the cleaning nozzle, wherein a ratio between a cross-sectional area of said gas ejection port at its downstream open end and a cross-sectional area of the minimum diameter portion is set to 1:1 to 1:1.3.

* * * * *